US007840159B2

(12) United States Patent
Nakashima

(10) Patent No.: US 7,840,159 B2
(45) Date of Patent: Nov. 23, 2010

(54) IMAGE-FORMING DEVICE HAVING A POSITIONING STRUCTURE

(75) Inventor: Atsuhisa Nakashima, Obu (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 24 days.

(21) Appl. No.: 12/361,960

(22) Filed: Jan. 29, 2009

(65) Prior Publication Data

US 2009/0202272 A1 Aug. 13, 2009

(30) Foreign Application Priority Data

Feb. 12, 2008 (JP) ..... 2008-030696

(51) Int. Cl.
*G03G 15/00* (2006.01)

(52) U.S. Cl. ..... 399/117; 399/110; 399/118

(58) Field of Classification Search ..... 399/110–113, 399/116, 117, 119
See application file for complete search history.

(56) References Cited

U.S. PATENT DOCUMENTS 5,475,484 A * 12/1995 Kimura ..... 399/130
5,978,626 A 11/1999 Nagamine et al.
6,252,619 B1 6/2001 Ueda et al.
6,879,791 B2 * 4/2005 Nakahara ..... 399/110

FOREIGN PATENT DOCUMENTS

| | | |
|---|---|---|
| JP | 2-188776 | 7/1990 |
| JP | 6-106814 | 4/1994 |
| JP | 2000-181165 | 6/2000 |
| JP | 2001-083860 | 3/2001 |
| JP | 2002-096500 | 4/2002 |
| JP | 2006-018128 | 1/2006 |
| JP | 2006-263985 | 10/2006 |

* cited by examiner

*Primary Examiner*—Hoang Ngo
(74) *Attorney, Agent, or Firm*—Scully, Scott, Murphy & Presser, P.C.

(57) ABSTRACT

An image-forming device includes a first frame, and a first supporting unit. The first frame includes a first plate-shaped part having a surface orthogonal to the first direction and supports a first image-bearing member. The first plate-shaped part is formed with at least two first positioning holes. Each of the at least two first positioning holes is defined by a first inner surface that extends in the first direction. The first supporting unit erects from the first plate-shaped part and includes at least two first fitting parts and a first contact part. The at least two first fitting parts fit into the at least two first positioning holes. The first contact part extends in the first direction from each of the at least two first fitting parts. The first contact part contacts and supports the exposure unit. The exposure unit is oriented in a direction in which the light emitted from the plurality of light emitting elements is directed toward a second direction orthogonal to the first direction.

17 Claims, 7 Drawing Sheets

UPPER
FRONT
RIGHT
LEFT
REAR
LOWER
40
48
48A
48B
49
42
42A
42B
42C
42D
42E
42F
41
41A
44
44A
44B
44C
44D
43
43A
43B
45
45A
45B
46A
46B
A

IMAGE-FORMING DEVICE HAVING A POSITIONING STRUCTURE

CROSS REFERENCE TO RELATED APPLICATION

This application claims priority from Japanese Patent Application No. 2008-030696 filed Feb. 12, 2008. The entire content of the priority application is incorporated herein by reference.

TECHNICAL FIELD

The invention relates to an image-forming device including a photosensitive member on which a latent image is formed when exposed to light, and an exposure unit for exposing the photosensitive member. The invention particularly relates to an image-forming device featuring a construction related to positioning the exposure unit relative to the photosensitive member.

BACKGROUND

One image-forming device well known in the art includes a photosensitive member on which a latent image is formed when exposed to light, an exposure unit having an exposure surface on which a plurality of light-emitting elements is arrayed along a scanning direction of the photosensitive member for exposing the photosensitive member, and an image-forming unit for forming an image on a recording medium that corresponds to the latent image formed on the photosensitive member. The light-emitting elements is arrayed on the exposure surface of the exposure unit. With this type of image-forming device, the light-emitting elements expose the photosensitive member based on image data to form a latent image on the photosensitive member corresponding to the image data. Subsequently, the image-forming unit configured of a developing unit forms an image on paper or another recording medium corresponding to the latent image formed on the photosensitive member, thereby forming an image on the recording medium that corresponds to the image data.

In order to form precise images on the recording medium, it is important that the exposure unit in this type of image-forming device be positioned accurately in relation to the photosensitive member. Japanese patent application publication No. 2000-181165, for example, proposes a method of positioning the exposure unit relative to the photosensitive member in which protrusions provided on the exposure surface of the exposure unit are fitted into recessions formed in the photosensitive member.

SUMMARY

However, it is not possible to accurately regulate the inclination of the exposure unit simply by fitting protrusions provided on the exposure surface of the exposure unit into recessions formed in the photosensitive member, as described in Japanese patent application publication No. 2000-181165. Accordingly, since the position of the exposure unit shifts relative to the photosensitive drum, there is a danger that images cannot be formed precisely.

In view of the foregoing, it is an object of the invention to provide an image-forming device including a photosensitive member in which latent images are formed through exposure, and an exposure unit for exposing the photosensitive member in which the position and angle of the exposure unit relative to the photosensitive member are precisely controlled.

In order to attain the above and other objects, the invention provides an image-forming device. The image-forming device includes a first image-bearing member, a first exposure unit, a first frame, and a first supporting unit. The first image-bearing member on which a latent image is formable, extends in a first direction. The first exposure unit includes a plurality of light-emitting elements arrayed along the first direction. The latent image is formed on the first image-bearing member by light emitted from the plurality of light-emitting elements thereonto. An image is formed on a recording medium based on the latent image on the fist image-bearing member. The first frame includes a first plate-shaped part having a surface orthogonal to the first direction and supports the first image-bearing member. The first plate-shaped part is formed with at least two first positioning holes. Each of the at least two first positioning holes is defined by a first inner surface that extends in the first direction. The first supporting unit erects from the first plate-shaped part and includes at least two first fitting parts and a first contact part. The at least two first fitting parts fit into the at least two first positioning holes. The, first contact part extends in the first direction from each of the at least two first fitting parts. The first contact part contacts and supports the exposure unit. The exposure unit is oriented in a direction in which the light emitted from the plurality of light emitting elements is directed toward a second direction orthogonal to the first direction.

According to another aspects, the invention provides an image-forming device. The image-forming device includes a first image-bearing member, a first exposure unit, a first frame and a first supporting unit. A latent image is formable on the first image-bearing member. The first image-bearing member extends in a first direction. The first exposure unit includes a plurality of light-emitting elements arrayed along the first direction. The latent image is formed on the first image-bearing member by light emitted from the plurality of light-emitting elements thereonto. An image is formed on a recording medium based on the latent image on the first image-bearing member. The first frame includes a first plate-shaped part having a surface orthogonal to the first direction and supports the first image-bearing member. The first supporting unit erects from the first plate-shaped part.

BRIEF DESCRIPTION OF THE DRAWINGS

Embodiments in accordance with the invention will be described in detail with reference to the following figures wherein:

FIG. 3(*b*) is an enlarged exploded perspective view showing a region of the LED unit around a guide roller;

FIG. 4(*b*) is a front view of the resin cover shown in FIG. 4(*a*);

FIG. 7(*b*) is a perspective view illustrating the structure of the front guide.

DETAILED DESCRIPTION

Figure 1:
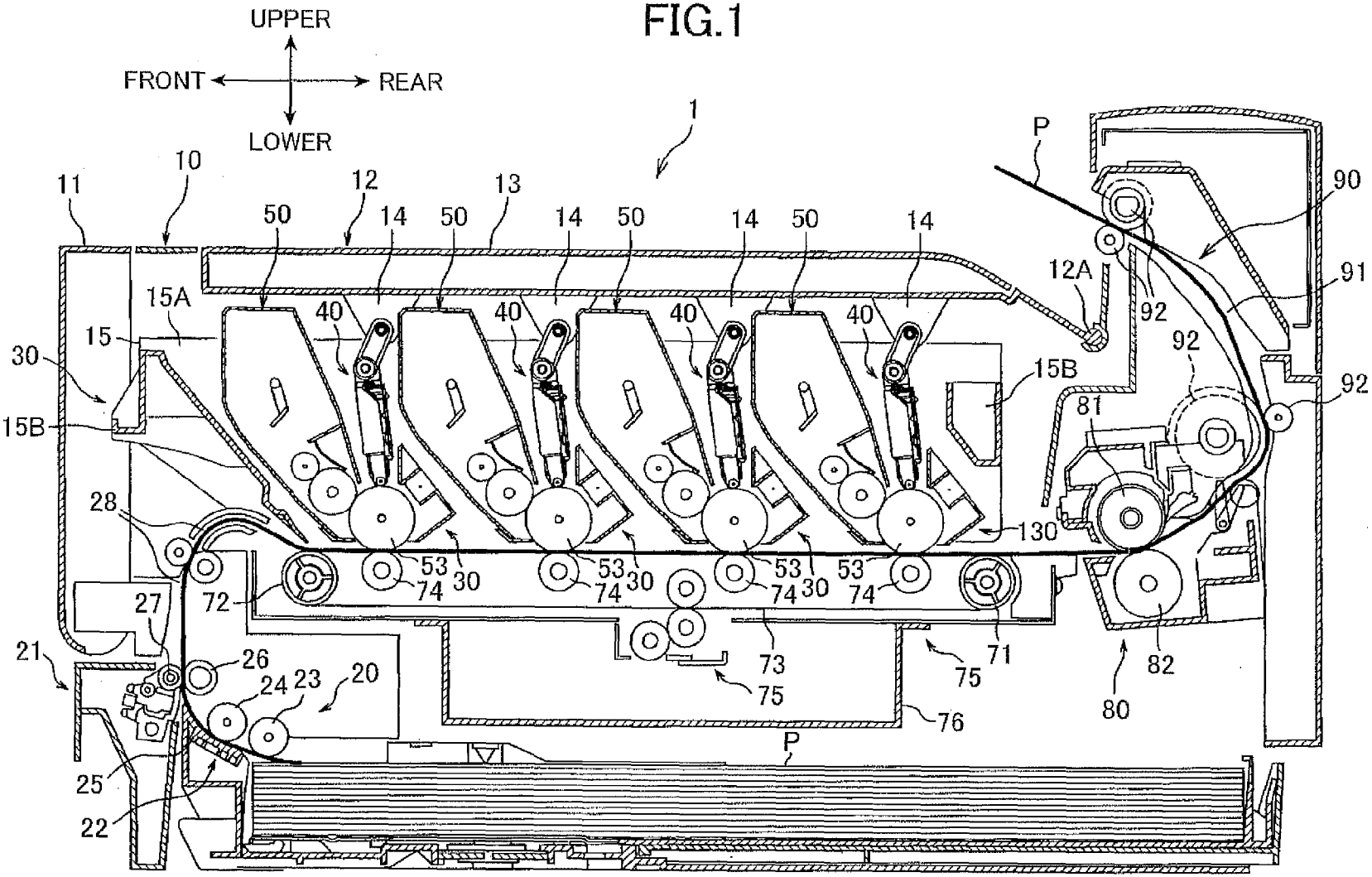
FIG. 1 is a side cross-sectional view showing a general structure of an image-forming device to which an invention is applied.

Next, an embodiment of the invention will be described while referring to the accompanying drawings. FIG. 1 is a side cross-sectional view showing the general structure of an image-forming device 1 to which the invention is applied. The terms "upward", "downward", "upper", "lower", "above", "below", "beneath", "right", "left", "front", "rear" and the like will be used throughout the description assuming that the image-forming device 1 is disposed in an orientation in which it is intended to be used. In use, the image-forming device 1 is disposed as is shown in FIG. 1.

(General Structure of the Image-Forming Device)

As shown in FIG. 1, the image-forming device 1 includes a main casing 10, and, within the main casing 10, a sheet-feeding unit 20 for supplying sheets of paper P, an image-forming section 130 for forming an image on the paper F supplied from the sheet-feeding unit 20, and a discharge unit 90 for discharging the paper P after an image has been formed thereon by the image-forming unit 130.

The image-forming device 1 further includes a front cover 11, an upper cover 12, a discharge tray 13, and a plurality of holding members 14. The front cover 11 is capable of being rotated open and closed on the front surface of the main casing 10 about an axis on the bottom edge thereof. The upper cover 12 is capable of being rotated open and closed on the top of the main casing 10 about hinges 12A provided on the rear edge of the upper cover 12. The discharge tray 13 is provided on the top surface of the upper cover 12 and functions to accumulate the paper P discharged from the main casing 10. The holding members 14 are provided on the bottom surface of the upper cover 12 for holding LED units 40 described later.

A main frame 15 is provided inside the main casing 10 for detachably accommodating four process cartridges 50 described later. The main frame 15 has a pair of side frames 15A (only one side is shown in FIG. 1) disposed on the left and right sides of the main casing 10, and a pair of cross members 15B disposed on the front and rear for linking the pair of side frames 15A. The main frame 15 is fixed to the main casing 10 and the like.

The sheet-feeding unit 20 is disposed in the bottom section of the main casing 10 and includes a feeding tray 21 detachably mounted in the main casing 10, and a paper-feeding mechanism 22 for conveying sheets of paper P from the feeding tray 21 to the image-forming unit 30. The paper-feeding mechanism 22 is provided on the front side of the feeding tray 21 and includes a feeding roller 23, a separating roller 24, and a separating pad 25.

The sheet-feeding unit 20 having this construction picks up and separates sheets of the paper P in the feeding tray 21 and conveys the sheets upward one sheet at a time. Each sheet fed by the sheet-feeding unit 20 passes between a paper dust roller 26 and a pinch roller 27, which remove paper dust from the sheet, and is subsequently supplied along a conveying path 28 to the image-forming unit 30.

The image-forming section 130 includes four image-forming unit 30 provided for each of the colors cyan, magenta, yellow, and black, four corresponding LED units 40 provided for each of the colors cyan, magenta, yellow, and black, four corresponding process cartridges 50, a transfer unit 70, and a fixing unit 80.

The process cartridges 50 are juxtaposed in the front-to-rear direction between the upper cover 12 and the sheet-feeding unit 20. As shown in the enlarged view of FIG. 2, each process cartridge 50 includes a drum unit 51 provided with a photosensitive drum 53, and a developing unit 61 detachably mounted in the drum unit 51. The photosensitive drum 53 is provided between the two side frames 15A. That is, two end of the photosensitive drum 53 in the left-to-right direction are located on the two side frames 15A. Each process cartridge 50 is supported in the side frames 15A. The photosensitive drum 53 has a rotational axis that extends in the left-to-right direction. The photosensitive drum 53 is rotatably disposed with respect to the process cartridge 50 about the rotational axis thereof. The photosensitive drum 53 is placed in a prescribed position in the side frames 15A according to a mechanism described later. The side frames 15A are disposed at the left and right ends of the photosensitive drum 53. The process cartridges 50 have the same construction, differing only in the color of toner accommodated in a toner-accommodating chamber 66 of the developing unit 61 described later.

Each drum unit 51 is provided with a drum frame 52, the photosensitive drum 53 rotatably supported in the drum frame 52, and a Scorotron charger 54. An exposure opening 55 is formed in a surface of the drum frame 52 opposing the top area of the photosensitive drum 53. The exposure opening 55 accepts insertion of the LED unit 40.

The developing unit 61 includes a developing frame 62, a developing roller 63, a supply roller 64, a thickness-regulating blade 65, and a toner-accommodating chamber 66 for accommodating toner. The supply roller 64 is rotatably supported in the developing frame 62. The toner-accomodating chamber 66 accommodates toner.

As shown in FIG. 1, the transfer unit 70 is provided between the sheet-feeding unit 20 and the process cartridges 50. The transfer unit 70 includes a drive roller 71, a follow roller 72, a conveying belt 73, transfer rollers 74, and a cleaning unit 75.

The drive roller 71 and follow roller 72 are arranged parallel to each other and separated in the front-to-rear direction. The conveying belt 73 is formed of an endless belt. The conveying belt 73 is mounted around the drive roller 71 and the follow roller 72. The outer surface of the conveying belt 73 contacts each of the photosensitive drums 53. Four of the transfer rollers 74 are disposed inside the conveying belt 73 at positions opposing the photosensitive drums 53 so as to pinch the conveying belt 73 against the photosensitive drums 53. During a transfer operation, a transfer bias is applied to the transfer rollers 74 according to constant current control.

The cleaning unit 75 is disposed beneath of the conveying belt 73 and is configured to remove toner deposited on the conveying belt 73 and to drop the removed toner into a toner collector 76 provided below the cleaning unit 75.

The fixing unit 80 is disposed rearward of the transfer unit 70 and includes a heating roller 81 and a pressure roller 82 that confronts and applies pressure to the heating roller 81.

With the image-forming unit 30 having this construction, first the Scorotron charger 54 uniformly charges the surface of the respective photosensitive drum 53. Next, the surface of the photosensitive drum 53 is exposed to an LED light irradiated by the respective LED unit 40. The potential on the surface of the photosensitive drum 53 in regions exposed to the LED light is reduced, forming an electrostatic latent image based on image data.

In the meantime, the supply roller 64 rotates to supply toner from the toner-accommodating chamber 66 onto the developing roller 63. As the developing roller 63 rotates, the thickness-regulating blade 65 regulates the amount of toner carried on the surface of the developing roller 63 to a thin layer of uniform thickness.

As regions of the developing roller 63 rotate into contact with the photosensitive drum 53, toner carried on the developing roller 63 in these regions is supplied to the electrostatic latent image formed on the photosensitive drum 53. The toner is selectively carried on regions of the photosensitive drum 53 corresponding to the latent image, thereby developing the latent image into a visible toner image through reverse development.

The toner images formed on each of the photosensitive drums 53 are sequentially transferred onto a sheet of paper P so as to be superimposed over each other as the sheet of paper P supplied from the conveying belt 73 passes between each photosensitive drum 53 and the corresponding transfer roller 74 provided on the inside of the conveying belt 73. Through this process, color images can be formed on the paper P. Subsequently, the toner images transferred onto the paper P are fixed by heat as the paper P passes between the heating roller 81 and pressure roller 82.

As shown in FIG. 1, the discharge unit 90 includes a discharge-side conveying path 91 and a plurality of pairs of conveying rollers 92. The conveying path 91 extends upward from the point that a sheet exits from the fixing unit 60, and curves back toward the front. A plurality of pairs of conveying rollers 92 conveys the paper P along this discharge-side conveying path 91. After toner images have been transferred to and fixed on the sheet of paper P, the conveying rollers 92 convey the sheet along the discharge-side conveying path 91 and discharge the sheet from the main casing 10 to be collected on the discharge tray 13.

(LED Units and Configuration for Positioning the Same)

Figures 3A, 3B:
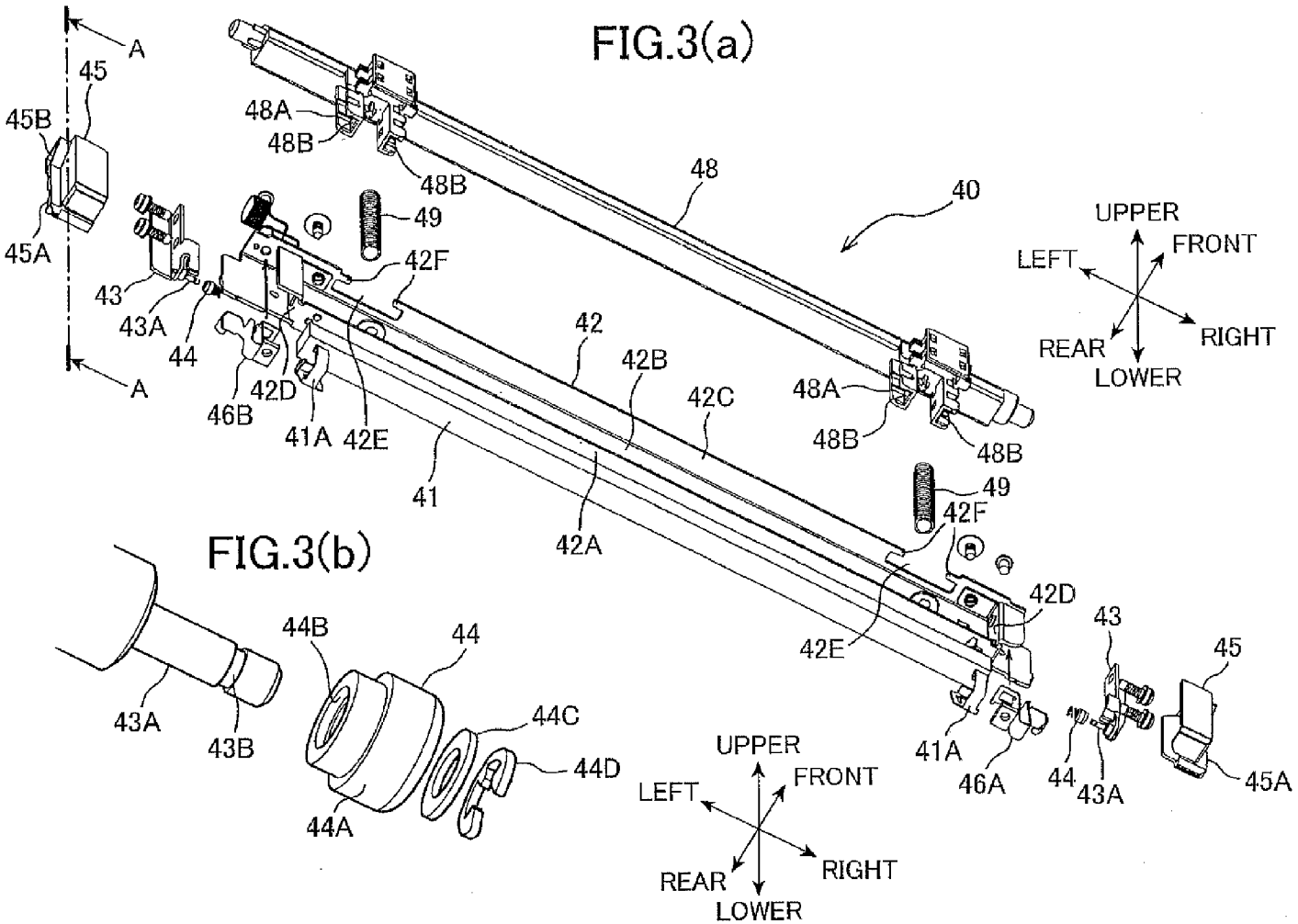
FIG. 3(*a*) is an exploded perspective view showing a structure of a LED unit.

Next, the LED units 40 and the configuration for positioning the LED units 40, which are features of the invention, will be described in detail. FIG. 3(*a*) is an exploded perspective view showing the structure of a LED unit 40, and FIG. 3(*b*) is an enlarged exploded perspective view showing the region of the LED unit 40 around a guide roller 44.

As shown in FIG. 3, the LED unit 40 includes an light source assembly 41, an exposure device frame 42, roller support members 43, guide rollers 44, resin covers 45, springs 46A and 46B, and a suspender 48.

A plurality of light-emitting units configured of LEDs (not shown) is arrayed in the left-to-right direction on the bottom of the light source assembly 41. The outer surface of the light source assembly 41 is formed of a synthetic resin and suppresses electrical discharge from high-voltage parts, such as the Scorotron charger 54. A control unit (not shown) inputs signals into the light source assembly 41 based on data for a desired image, causing the light-emitting units to emit light that is irradiated on the photosensitive drum 53.

The exposure device frame 42 is a conductive frame member formed by pressing a metal plate into a shape having three sides substantially at right angles to each other, and functions to support the light source assembly 41. More specifically, the exposure device frame 42 has a bottom plate 42A, a side plate 42B, and a top plate 42C forming a member elongated in the left-to-right direction. The bottom plate 42A, the side plate 42B, and the top plate 42C form three sides of a rectangle in a cross section perpendicular to the left-to-right direction. End plates 42D are formed on left and right ends (hereinafter simply referred to as "both ends") of the bottom plate 42A by bending the ends of the bottom plate 42A. Two openings 42E are formed in the top plate 42C. The openings 42E are formed near both ends of the top plate 42C in the left-to-right direction and are open on the front edge. A pair of engaging pawls 42F extend toward each other in the left and right directions along the front open edge of each opening 42E, narrowing the open edge of the opening 42E. The light source assembly 41 described above is fixedly mounted from below on the bottom plate 42A of the exposure device frame 42 by two clips 41A.

The roller support members 43 are brackets formed by pressing conductive metal plates and are fixed by screws to the end plates 42D on both ends of the exposure device frame 42. A roller shaft 43A is provided on the bottom end of each roller support member 43 so as to extend inward in the left and right directions. The roller shafts 43A rotatably support the guide rollers 44. As shown in FIG. 3(*b*), an engaging groove 43B is formed circumferentially in the roller shaft 43A.

The guide roller 44 is substantially cylindrical in shape; that is, a rolling surface 44A of the guide roller 44 is cylindrical in shape. A center hole 44B is formed in the center axis of the rolling surface 44A for engaging with the roller shaft 43A. The guide roller 44 is attached to the roller shaft 43A by inserting the roller shaft 43A through the center hole 44B and subsequently through a washer 44C and by engaging a clip 44D in the engaging groove 43B.

Figure 2:
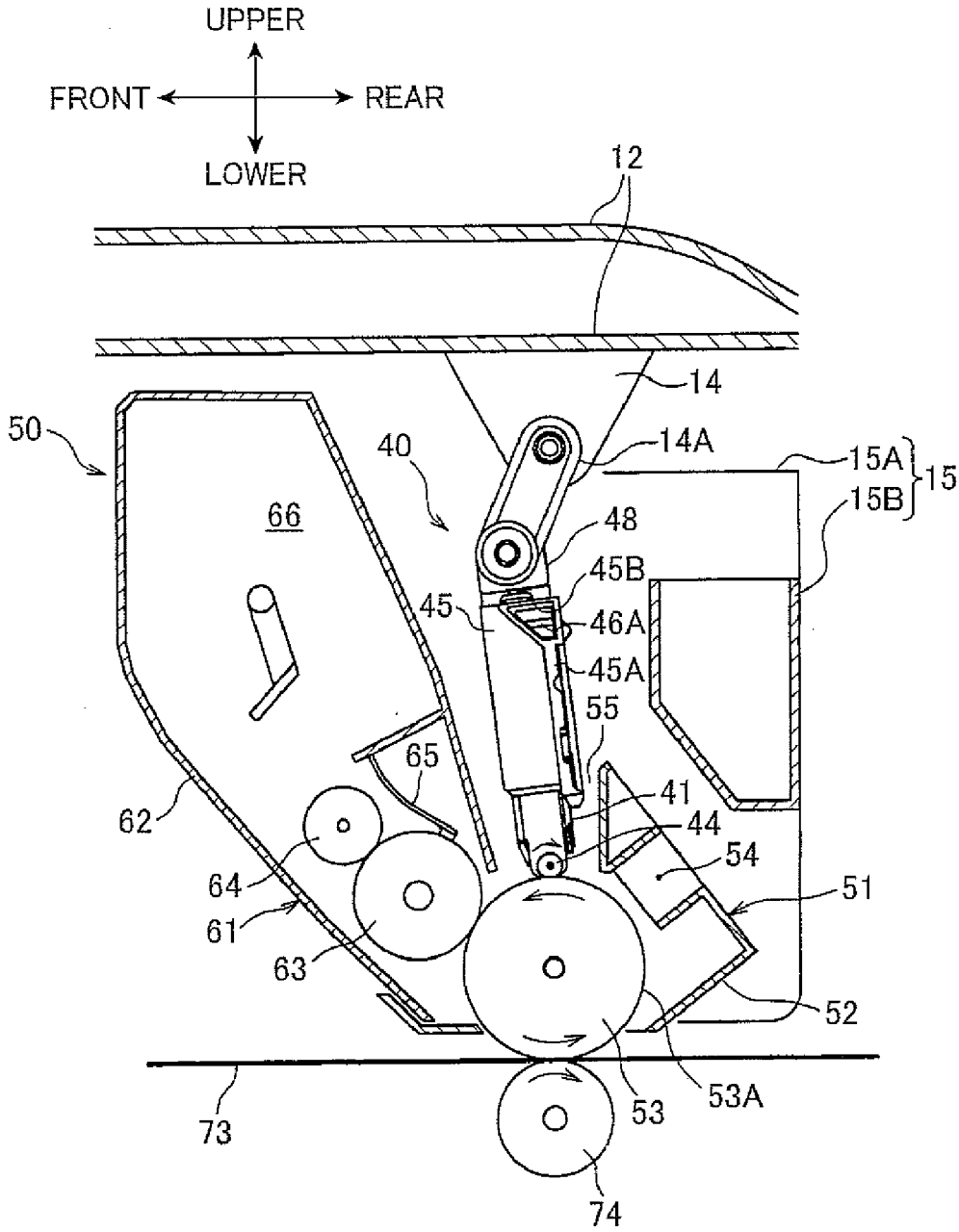
FIG. 2 is an enlarged view showing the structure around an LED unit of the image-forming device.

As shown in FIG. 2, the guide rollers 44 roll in contact with a peripheral surface 53A of the photosensitive drum 53 so as to regulate the distance between the bottom surface of the LED unit 40 and the peripheral surface 53A of the photosensitive drum 53. The guide rollers 44 are disposed at positions on the peripheral surface 53A that are outside an image-forming region of the peripheral surface 53A in which toner is supplied, so as not to affect image formation. The positions at which the guide rollers 44 are disposed are outside a latent image region in which the latent image is formed by light transmitted from the light source assembly.

Figure 4A:
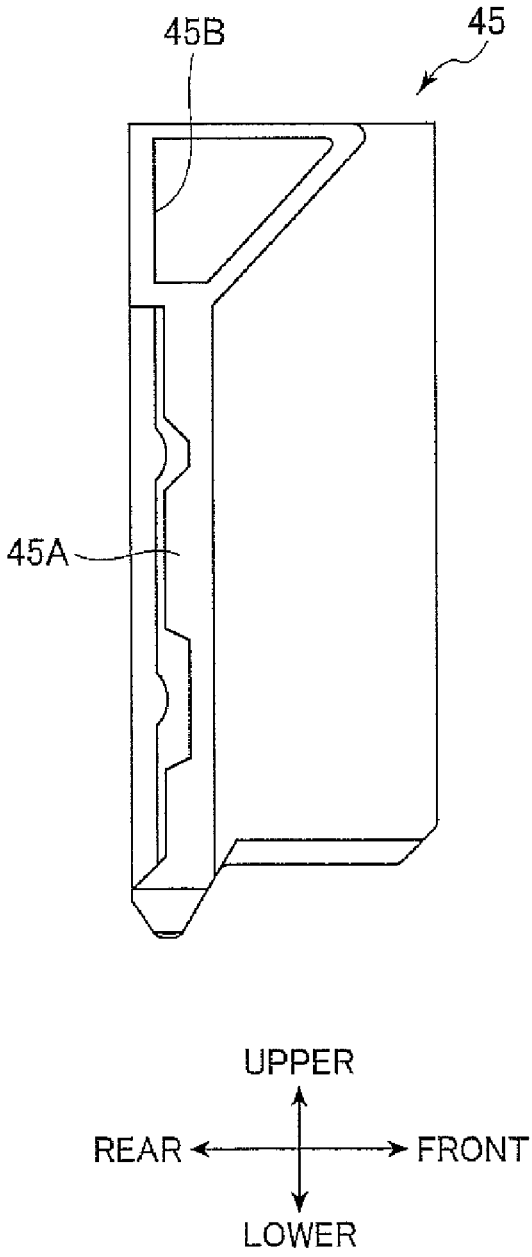
FIG. 4(*a*) is a side view of a resin cover that is located on a left side of an exposure device frame.
Figure 4B:
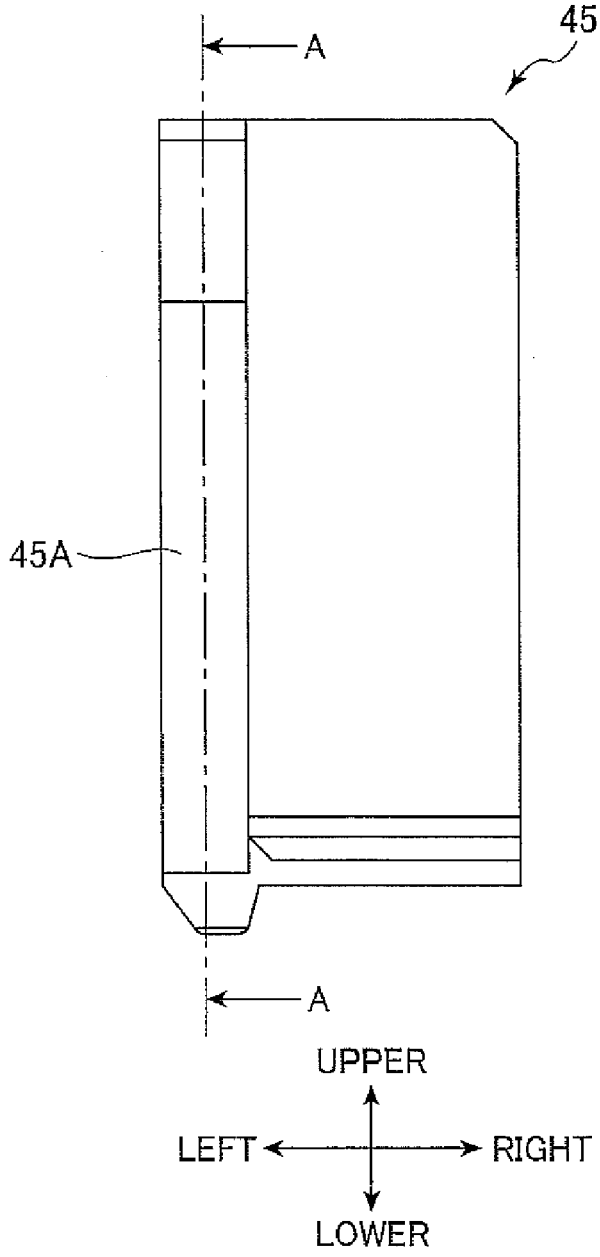

The resin covers 45 function to cover metal parts on both ends of the exposure device frame 42. The two resin covers 45 provided on the left or right of the exposure device frame 42 are symmetrical to each other in the left-to-right direction. FIG. 4(*a*) is a side view of the resin cover 45 that is located on the left side of the exposure device frame 42. FIG. 4(*b*) is a front view of the resin cover 45 shown in FIG. 4(*a*). The resin covers 45 are formed of an insulating resin material. The resin covers 45 have guide ribs 45A. More specifically, as shown in FIG. 4(*b*) the guide rib 45A that is provided on the resin cover 45 located on the left side of the exposure device frame 42 protrudes toward the left direction. Similarly, the guide rib 45A that is provided on the resin cover 45 located on the right side of the exposure device frame 42 protrudes toward the right direction. Each guide rib 45A extends vertically. The upper end of each guide ribs 45A has a triangular outline when viewed from the left or the right end, with a through-hole 453 formed inside the triangular portion. The springs 46A and 46B are exposed in the respective through-holes 45B.

As shown in FIG. 3(*a*), the springs 46A and 46B are metal leaf springs having conductivity and are fixed to both ends of the exposure device frame 42 by screws. The spring 46B on the left side of the exposure device frame 42 is thicker than the spring 46A disposed on the right side. Therefore, the force generated by the spring 46B is greater than that generated by the spring 46A. Both ends of the springs 46A and 46B (the ends facing outward in the left and right directions) protrude out from the through-holes 45B of the resin covers 45 when not applying a load. The springs 46A and 46B are disposed in the same position when viewed in the left and right direction. Therefore, when the LED unit 40 is mounted in the main frame 15, the springs 46A and 46B contact the respective side frames 15A, generating an urging force that acts in the left and right directions, without generating a force that acts to rotate the LED unit 40. In this case, because the force generated by the spring 46B is greater than that generated by the spring 46A, the LED unit 40 is pushed on the right side, that is, the LED unit 40 is disposed at a position that is nearer the side frame 15A than the left side frame 15A. Accordingly, the LED unit 40 is disposed at an accurate position with respect to the left-to-right direction when mounted on the main frame 15.

The suspender 48 supports the exposure device frame 42 and the light source assembly 41 in a suspended state. The length of the suspender 48 in the left-to-right direction is equivalent to that of the exposure device frame 42. The suspender 48 is also provided with engaging members 48A in two locations corresponding to the two openings 42E. Each of the engaging members 48A has two portions that have a square C-shaped cross section that opens outward in the left and right directions, respectively, when viewed from the bottom. Openings 48B in the square C-shaped cross sections engage loosely with the engaging pawls 42F.

A compressed spring 49 is disposed between the exposure device frame 42 and each engaging member 48A and is positioned inside each of the guide rollers 44 in the left-to-right direction. Once the engaging members 48A are engaged with the openings 42E and engaging pawls 42F of the exposure device frame 42 with play and locked by retaining members (not shown), the exposure device frame 42 and light source assembly 41 are constantly urged downward by the compressed springs 49.

As shown in FIG. 2, each LED unit 40 is attached to the upper cover 12, and specifically to the holding member 14 via link 14A. The links 14A are capable of rotating in the side view of FIG. 2 at the points of connection with the holding members 14 and the LED unit 40. In other words, the links 14A are capable of rotating about an axis parallel to the left-to-right direction. This rotation of the link 14A allows the LED unit 40 to rotate freely and change its angle of disposition. Accordingly, the LED unit 40 can be easily engaged with the side frames 15A, as will be described later.

Each of the LED units 40 is attached to and hangs down from the upper cover 12. The LED units 40 interlock with the rotation of the upper cover 12. Since the upper cover 12 can rotate open and closed about the hinges 12A, as described above, the photosensitive drums 53 and the LED units 40 can move relative to each other between an exposing position in which the photosensitive drums 53 and the LED units 40 are close together, and a retracted position in which the photosensitive drums 53 and the LED units 40 are separated. At the exposing position, the LED unit 40 emits light to the photosensitive drum 53 to form the latent image when an image is formed on the recording medium. When the LED unit 40 is in the exposing position, the guide rollers 44 provided on the bottom end thereof contact the peripheral surface 53A of the photosensitive drum 53 near the top thereof. Accordingly, the distance between the light source assembly 41 and the peripheral surface 53A is maintained constant.

Figure 5:
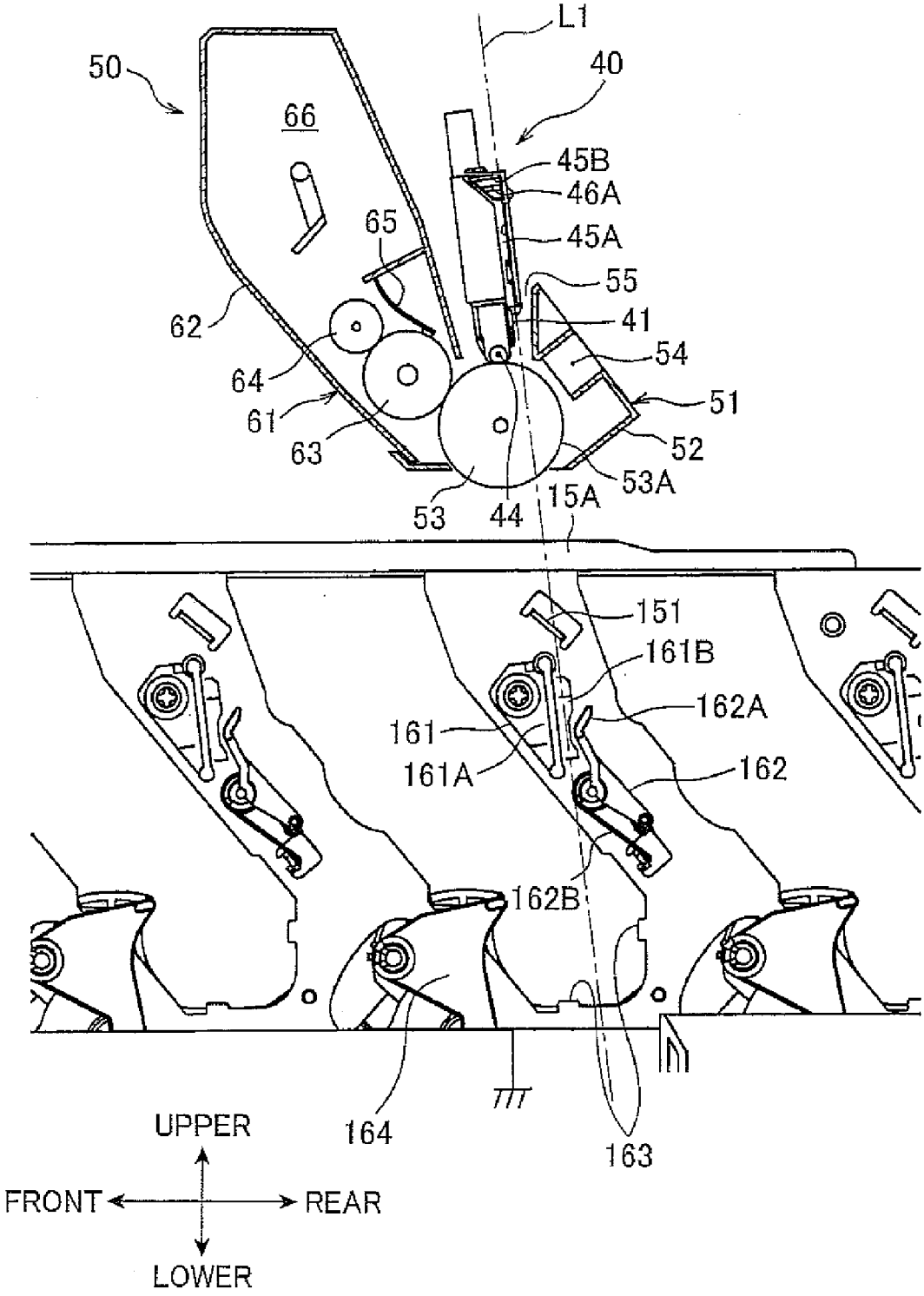
FIG. 5 is a side view showing a structure of support mechanisms in the side frames for supporting the LED unit.

FIG. 5 is a side view showing the structure of support mechanisms in the side frames 15A for supporting the LED unit 40. As shown in FIG. 5, a front guide 161 and a rear guide 162 are provided on each of the side frames 15A at locations corresponding to both ends of each LED unit 40 when the four LED units 40 are mounted. In other words, two front guides 161 located on the two side frames 15A are symmetrical each other in the left-to-right direction. Further, two rear guide 162 located on the two side frames 15A are symmetrical each other in the left-to-right direction.

A rib 161A is formed on the front guide 161. Each front guide 161 extends substantially vertically and protrudes inward with respect to the left or right direction. When the LED unit 40 is mounted in the main frame 15, the rib 161A is positioned on the front side of the corresponding guide rib 45A. A protruding part 161B is provided on the rear edge of the front guide 161 along the rib 161A. The protruding part 161B has a surface that is contacted by the outer endface of each guide rib 45A provided on both ends of the LED unit 40 to restrict the left-to-right positioning of the LED unit 40.

An arm 162A is formed on the rear guide 162 and extends upward therefrom. When the LED unit 40 is mounted in the main frame 15, a torsion coil spring 162B urges the arm 162A to press against the rear side of the guide rib 45A. That is, the LED unit 40 is held by the rib 161A and the torsion coil spring 162B with the LED unit 40 interposed therebetween. The front guide 161 and rear guide 162 are both formed of synthetic resin to suppress wear caused by sliding contact from the LED unit 40.

A spring contact part 151 is formed on the side frame 15A approximately above the protruding part 161B. The spring contact part 151 bends part of the side frame 15A inward with respect to the left or right direction and thus is erected from the surface of the side frame 15A toward the left or right direction. When the LED unit 40 is mounted in the main frame 15, the spring contact part 151 is disposed at a position to be contacted by the spring 46A or 46B. As indicated in FIG. 5, the side frame 15A is electrically grounded. Thus, the exposure device frame 42 is electrically grounded via the springs 46A and 46B and the side frames 15A.

The LED unit 40 is mounted in the side frames 15A from the retracted position to the exposing position by inserting the guide ribs 45A along a line L1 between corresponding ribs 161A and arms 162A. Although the line L1 is depicted as a straight line in FIG. 5 to illustrate the mounting position, the LED unit 40 actually rotates downward along with the rotation of the upper cover 12 when mounted rather than moving linearly.

Further, contact parts 163 are provided on each side frame 15A for receiving the drum frame 52 that rotatably supports the photosensitive drum 53. A pivotable locking member 164 is provided on each side frame 15A for locking the drum frame 52 mounted on the contact parts 163 so that the drum frame 52 does not separate therefrom. The side frames 15A essentially have a flat plate shape, excluding regions provided with the spring contact parts 151 and the like. The contact parts 163 are formed simultaneously with positioning holes 166C and 166D described next (see FIG. 6) through a single pressing of this plate.

Figure 6B:
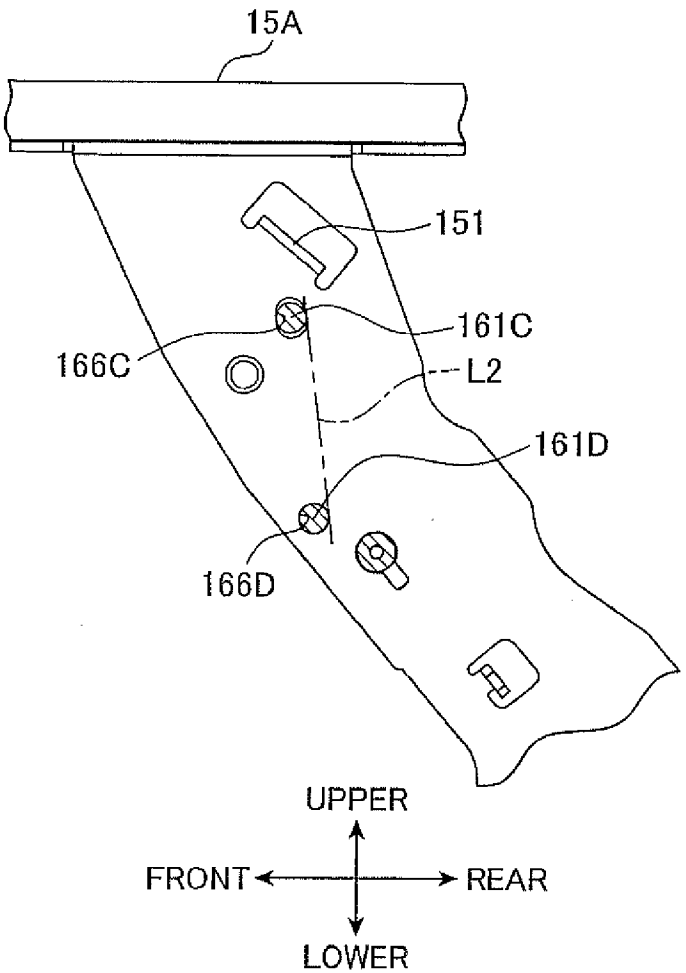
FIG. 6(*a*) is a cross-sectional view showing a structure near the resin cover when the LED unit is mounted in the side frames and FIG. 6(*b*) is a cross-sectional view of the front guide fixed to the side frame.
Figure 6A:
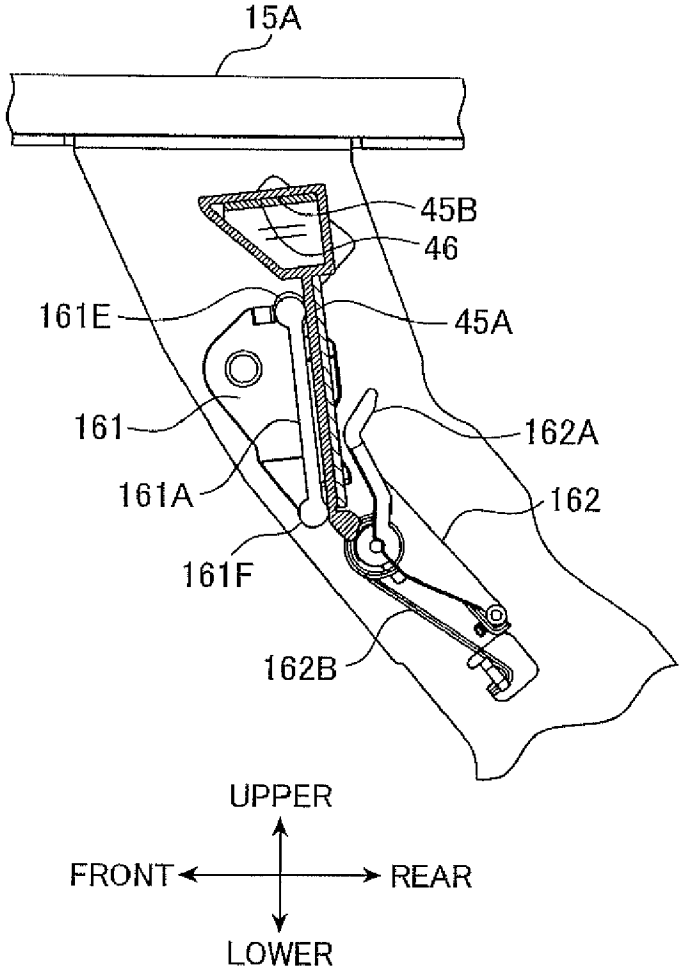

Next, the structure of the front guide 161 and the structure for fixing the front guide 161 to the side frame 15A will be described in detail with reference to FIGS. 6(*a*), 6(*b*), 7(*a*) and 7(*b*) FIG. 6(*a*) is a cross-sectional view showing the structure near the resin cover 45 when the LED unit 40 is mounted in the side frames 15A, the cross section corresponding to the plane indicated by the line A-A in FIGS. 3(*a*) and 4(*b*). FIG. 6(*b*) is a cross-sectional view of the front guide 161 fixed to the side frame 15A taken along the base ends of bosses 161C and 161D (equivalent to the plane indicated by the line B-B in FIG. 7(*a*) and 7(*b*)).

Figure 7A:
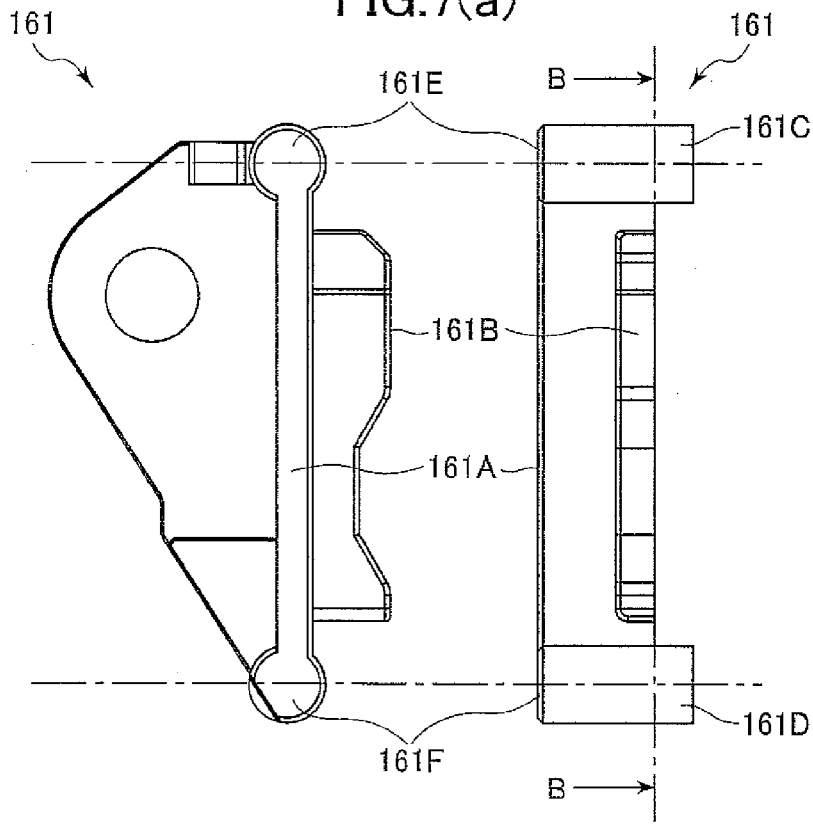
FIG. 7(*a*) shows a side view and a front view of a front guide.
Figure 7B:
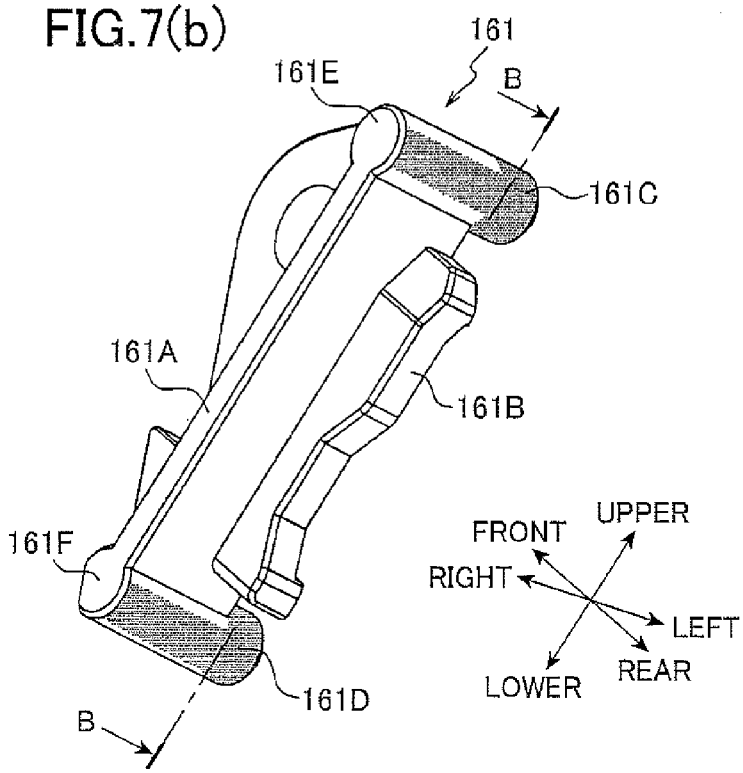

As shown in FIG. 6(*a*), the LED unit 40 is positioned by interposing the guide ribs 45A of the resin covers 45 between the respective ribs 161A of the front guides 161 and the arms 162A of the rear guides 162, with the guide rollers 44 contacting the peripheral surface 53A of the photosensitive drum 53. FIG. 7(*a*) shows the front guide 161 that is located on the left of the side frame 15A. Specifically, the left side of FIG. 7(*a*) shows the left side view of the front guide 161 and the right side of FIG. 7(*a*) shows the front side view of the-front guide 161. FIG. 7(*b*) shows a perspective view of the front guide 161. The front guide 161 that is located on the right side of the side frame 15A is symmetrical to the front guide 161 shown in FIG. 7(*a*) in the left-to-right direction. As shown in FIGS. 7(*a*) and 7(*b*), each front guide 161 includes cylindrical bosses 161C and 161D. The bosses 161C and 161D fit into positioning holes 166C and 166D formed in the respective side frame 15A. The rib 161A of the front guide 161 also has a top edge 161E and a bottom edge 161F, forming enlarged cylindrical shapes on the rib 161R that connect to the bosses 161C and 161D. In other words, the top edge 161E and the bottom edge 161E have a disk shaped part at the right side and a cylindrical shaped part that connects to the bosses 161C and 161D respectively.

FIG. 7(*b*) illustrates the shape of dies required for molding the front guide 161 with synthetic resin by indicating a portion molded by one die in a neutral color. As shown in FIG. 7(*b*), the bosses 161C and 161D in their entirety and the rear side surfaces of the top edge 161E and bottom edge 161F on the rib 161A are molded using a single integrated die. That is, the bosses 161C and 161D in their entirety and the rear side surfaces of the top edge 161E and bottom edge 161F on the rib 161A are formed integrally. Although hidden in FIG. 7(*b*), the left side surfaces of the rib 161A and the protruding part 161B are also molded using the single integrated die used for forming the bosses 161C and 161D and the like.

On the other hand, the positioning holes 166C and 166D are formed in the side frame 15A at positions separated vertically, as shown in FIG. 6(*b*). The rear inner peripheral surfaces of the positioning holes 166C and 166D are disposed along a line L2 indicating the desired position for the front endfaces of the guide ribs 45A. Further, the upper positioning hole 166C has an oval shape elongated in a direction along the line L2. The minor diameter of the positioning hole 166C is substantially equivalent to that of the boss 160C, and the diameter of the lower positioning hole 166D is substantially equivalent to that of the boss 161D.

Accordingly, when the front guide 161 is fixed perpendicular to the side frame 15A by fitting (inserting with light pressure, for example) the bosses 161C and 161D into the corresponding positioning holes 166C and 166D, the rear surfaces of the top edge 161E and the bottom edge 161E on the rib 161A are positioned along the line L2. In other words, a line connecting the rear surfaces of the top edge 161E and the bottom edge 161F is parallel to the line L2. Moreover, the positioning holes 166C and 166D are vertically disposed in the plate-shaped portion of the side frames 15A, i.e., a surface orthogonal to the scanning direction extending in the left-to-right direction. So, the rear surfaces of the top edge 161E and the bottom edge 161F of the rib 161A also extend along the scanning direction from the rear inner peripheral surfaces of the positioning holes 166C and 166D. Hence, when mounting the LED unit 40, the position and angle of the LED unit 40 can be set accurately by placing the front endfaces of the guide ribs 45A in contact with the rear surfaces of the top edge 161E and the bottom edge 161F of the rib 161A. When the LED unit 40 is mounted in the side frames 15A, the front endface of the guide rib 45A contacts with the rear surfaces of the top edge 161E and the bottom edge 161F. Thus, the guide rib 45A is located along the line L1. Accordingly, the plurality of light-emitting units in the light source assembly 41 emits light toward the photosensitive drum 53.

Effects and Variations of the Embodiment

With the image-forming device 1 according to the embodiment described above, the top edge 161E and the bottom edge 161F on the rib 161A of the front guide 161 extend along the scanning direction from the inner peripheral surfaces of the positioning holes 166C and 166D. By placing the top edges 161E and the bottom edges 161F of the ribs 161A in contact with the front endfaces of the corresponding guide ribs 45A, the position and angle of the LED unit 40 can be set accurately.

Moreover, the bosses 161C and 161D that are fitted into the positioning holes 166C and 166D are molded using the same die used for molding the parts (rear surfaces) of the top edge 161E and the bottom edge 161F on the rib 161A that contact the guide ribs 45A. Therefore, positional deviation (tolerance) between the inner peripheral surfaces of the positioning holes 166C and 166D and the rear surfaces of the top edge 161E and the bottom edge 161F on the rib 161A is extremely small. Further, the contact parts 163 supporting the drum frame 52 and the positioning holes 166C and 166D are formed simultaneously in a single pressing. Therefore, the positional error (tolerance) between the photosensitive drum 53 and the positioning holes 166C and 166D is extremely small.

Further, the guide rollers 44 define the gap between the bottom surface (exposure surface) of the light source assembly 41 and the peripheral surface 53A of the corresponding photosensitive drum 53. Since the front endfaces of the guide ribs 45A that contacts the front guides 161 are in parallel with a direction from the bottom the light source assembly 41 to the peripheral surface 53A of the photosensitive drum 53, the LED unit 40 is positioned in two directions that is orthogonal to the rotational axis of the photosensitive drum 53. Therefore, in the image-forming device 1 according to the embodiment, both the position and angle of the LED unit 40 relative to the photosensitive drum 53 can be set with great accuracy in order to form images with great precision. Since the image-forming device 1 is a tandem image-forming device, forming precise images for each color, as described above, can greatly reduce the occurrence of color registration problems.

While the invention has been described in detail with reference to the above embodiments thereof, it would be apparent to those skilled in the art that various changes and modifications may be made therein without departing from the spirit of the invention.

For example, the photosensitive member may be a belt-shaped member, and the light-emitting elements may be electroluminescence (EL) elements or phosphors. Further, the invention can be applied to a variety of image-forming devices, including a monochrome printer, a facsimile machine, a copier, and a color printer employing an intermediate transfer belt.

What is claimed is:

1. An image-forming device comprising:

a first photosensitive drum that is rotatable about an axis parallel to a first direction, the photosensitive drum having a latent image region in which the latent image is formable, the first photosensitive drum extending in the first direction;

a first exposure unit that includes:

a plurality of light-emitting elements arrayed along the first direction, the latent image being formed in the latent image region by light emitted from the plurality of light-emitting elements thereonto, an image being formed on a recording medium based on the latent image in the latent image region; and a gap-regulating unit that regulates a gap between the plurality of light emitting elements and the first photosensitive drum, the gap regulating unit including two guide rollers that contact with the photosensitive drum at positions outside the latent image region;

a first frame that includes a first plate-shaped part having a surface orthogonal to the first direction and supports the first photosensitive drum, the first plate-shaped part being formed with at least two first positioning holes, each of the at least two first positioning holes being defined by a first inner surface that extends in the first direction; and a first supporting unit that erects from the first plate-shaped part and includes:

at least two first fitting parts that fit into the at least two first positioning holes; and a first contact part that extends in the first direction from each of the at least two first fitting parts, the first contact part contacting and supporting the first exposure unit, wherein the first exposure unit is oriented in a direction in which the light emitted from the plurality of light emitting elements is directed toward a second direction orthogonal to the first direction.

2. The image-forming device according to claim 1, further comprising an opposing contact part, the first exposure unit being held by the first contact part and the opposing contacting part urged against the first contact part with the first exposure unit interposed therebetween.

3. The image-forming device according to claim 1, further comprising a second photosensitive drum and a second exposure unit, a latent image being formed on the second photosensitive drum by light emitted from a plurality of light-emitting elements arrayed on the second exposure unit, wherein an image is formed on a recording medium by superposing images corresponding to latent images formed on the first photosensitive drum and the second photosensitive drum.

4. The image-forming device according to claim 1, wherein the first supporting unit is formed by molding synthetic resin using dies, the first contact part and the first fitting part being formed by a single die.

5. The image-forming device according to claim 1, wherein the first frame further includes a photosensitive drum contact part contacting and supporting the first photosensitive drum, wherein the photosensitive drum contact part and the at least two first positioning holes are formed simultaneously by press molding the first plate-shaped part of the first frame a single time.

6. The image-forming device according to claim 2, wherein the opposing contact part is formed on the first frame.

7. The image-forming device according to claim 1, further comprising a cover that covers the first photosensitive drum and the first exposure unit and is configured of being rotated open and closed, wherein the first exposure unit is rotatably attached to the cover and is interlocked with a rotation of the cover;

wherein when the upper cover is open, the first exposure unit separates the contact part whereas when the upper cover is closed, the first exposure unit contacts to the first contact part.

8. The image-forming device according to claim 1, further comprising:

a second frame that includes a second plate-shaped part having a surface orthogonal to the first direction, the second plate-shaped part being formed with at least two second positioning holes, each of the at least two second positioning holes being defined by a second inner surface that extends in the first direction, the first photosensitive drum having two ends with respect to the first direction, each of the first frame and the second frame being provided at one end of the first photosensitive drum and supporting the first photosensitive drum; and a second supporting unit that has a symmetrical structure to the first supporting unit and that erects from the second plate-shaped part and includes:

at least two second fitting parts that fit into the at least two second positioning holes; and a second contact part that extends in the first direction from each of the at least two second fitting parts, the first and second contact parts contacting and supporting the first exposure unit wherein the first exposure unit is oriented in the direction in which the light emitted from the plurality of light emitting elements is directed toward the second direction orthogonal to the first direction.

9. The image-forming device according to claim 8, wherein the first exposure unit has two ends with respect to the first direction and includes two leaf springs each provided at one end of the first exposure unit, the two leaf springs having different thickness and generating different forces, the two leaf springs urging the first and second frames.

10. The image-forming device according to claim 1, wherein the first contact part contacts the first exposure unit at two different positions.

11. An image-forming device comprising:

a first image-bearing member on which a latent image is formable, the first image-bearing member extending in a first direction;

a first exposure unit that includes a plurality of light-emitting elements arrayed along the first direction, the latent image being formed on the first image-bearing member by light emitted from the plurality of light-emitting elements thereonto, an image being formed on a recording medium based on the latent image on the first image-bearing member;

a first frame that includes a first plate-shaped part having a surface orthogonal to the first direction and supports the first image-bearing member;

a first supporting unit that erects from the first plate-shaped part;

a first contact part that extends in the first direction from each of the at least two first fitting parts, the first contact part contacting and supporting the first exposure unit; and an opposing contact part, the first exposure unit being held by the first contact part and the opposing contacting part urged against the first contact part with the first exposure unit interposed therebetween.

12. An image-forming device comprising:

a first image-bearing member on which a latent image is formable, the first image-bearing member extending in a first direction;

a first exposure unit that includes a plurality of light-emitting elements arrayed along the first direction, the latent image being formed on the first image-bearing member by light emitted from the plurality of light-emitting elements thereonto, an image being formed on a recording medium based on the latent image on the first image-bearing member;

a first frame that includes a first plate-shaped part having a surface orthogonal to the first direction and supports the first image-bearing member, the first plate-shaped part being formed with at least two first positioning holes, each of the at least two first positioning holes being defined by a first inner surface that extends in the first direction; and a first supporting unit that erects from the first plate-shaped part and includes:

at least two first fitting parts that fit into the at least two first positioning holes; and a first contact part that extends in the first direction from each of the at least two first fitting parts, the first contact part contacting and supporting the first exposure unit, wherein the first exposure unit is oriented in a direction in which the light emitted from the plurality of light emitting elements is directed toward a second direction orthogonal to the first direction, wherein the first supporting unit is formed by molding synthetic resin using dies, the first contact part and the first fitting part being formed by a single die.

13. The image-forming device according to claim 12, further comprising an opposing contact part, the first exposure unit being held by the first contact part and the opposing contacting part urged against the first contact part with the first exposure unit interposed therebetween.

14. The image-forming device according to claim 12, further comprising a second image-bearing member and a second exposure unit, a latent image being formed on the second image-bearing member by light emitted from a plurality of light-emitting elements arrayed on the second exposure unit, wherein an image is formed on a recording medium by superposing images corresponding to latent images formed on the first image-bearing member and the second image-bearing member.

15. The image-forming device according to claim 12, wherein the first frame further includes an image bearing member contact part contacting and supporting the first image-bearing member, wherein the first image-bearing member and the at least two first positioning holes are formed simultaneously by press molding the first plate-shaped part of the first frame a single time.

16. The image-forming device according to claim 12, wherein the first exposure unit further comprises:

a gap-regulating unit that regulates a gap between the plurality of light emitting elements and the first image-bearing member.

17. The image-forming device according to claim 16, wherein the first image-bearing member includes a photosensitive drum that is rotatable about an axis parallel to the first direction, the photosensitive drum having a latent image region in which the latent image is formed, wherein the gap regulating unit includes two guide rollers that contact with the photosensitive drum at positions outside the latent image region.

* * * * *